US012331948B2

(12) United States Patent
Fukuyama et al.

(10) Patent No.: US 12,331,948 B2
(45) Date of Patent: Jun. 17, 2025

(54) AIR CONDITIONING SYSTEM FOR SELECTIVELY SUPPRESSING INDOOR AND OUTDOOR UNIT OPERATION

(71) Applicant: DAIKIN INDUSTRIES, LTD., Osaka (JP)

(72) Inventors: Yuuta Fukuyama, Osaka (JP); Hiroki Sasayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 372 days.

(21) Appl. No.: 17/890,069

(22) Filed: Aug. 17, 2022

(65) Prior Publication Data

US 2022/0390136 A1 Dec. 8, 2022

Related U.S. Application Data

(63) Continuation of application No. PCT/JP2021/011091, filed on Mar. 18, 2021.

(30) Foreign Application Priority Data

Apr. 2, 2020 (JP) ..... 2020-066857

(51) Int. Cl.
*F24F 11/63* (2018.01)

(52) U.S. Cl.
CPC ..... *F24F 11/63* (2018.01)

(58) Field of Classification Search
CPC .. F24F 11/46; F24F 11/30; F24F 11/54; F24F 11/65; F24F 11/38; F24F 11/86;
(Continued)

(56) References Cited

U.S. PATENT DOCUMENTS

2016/0245569 A1* 8/2016 Unezaki ..... F24F 11/62
2018/0274836 A1* 9/2018 Tsuji ..... F25B 49/022
(Continued)

FOREIGN PATENT DOCUMENTS

EP 2 944 890 A1 11/2015
JP 4-369339 A 12/1992
(Continued)

OTHER PUBLICATIONS

International Search Report for PCT/JP2021/011091 (PCT/ISA/210) mailed on Apr. 27, 2021.
(Continued)

*Primary Examiner* — Darrin D Dunn
(74) *Attorney, Agent, or Firm* — Birch, Stewart, Kolasch & Birch, LLP

(57) ABSTRACT

An air conditioning system includes an outdoor unit including a control device, an indoor unit communicably connected to the control device, and an outside air processor communicably connected to the control device. The indoor unit is capable of performing ordinary operation control to adjust a temperature of air in a room, the air being taken in the indoor unit, and supply the air into the room, and output restriction control under which an output is restricted as compared with an output under the ordinary operation control. The outside air processor is capable of performing ordinary operation control to adjust at least one of a temperature and a humidity of air outside the room, the air being taken in the outside air processor, and supply the air into the room, and output restriction control under which an output is restricted as compared with an output under the ordinary operation control. The control device causes the outside air processor to shift from the ordinary operation control to the output restriction control on condition that the indoor unit
(Continued)

shifts from the ordinary operation control to the output restriction control.

12 Claims, 6 Drawing Sheets

(58) Field of Classification Search
CPC ..... G05B 15/02; G05B 19/042; G05B 2219/2614; G05B 23/0291
See application file for complete search history.

(56) References Cited

U.S. PATENT DOCUMENTS

| | | | | |
|---|---|---|---|---|
| 2020/0033018 | A1* | 1/2020 | Nabeshima | F24F 1/14 |
| 2020/0080742 | A1* | 3/2020 | Okamoto | G05B 17/02 |
| 2020/0142391 | A1* | 5/2020 | Bicknell | G06F 11/0751 |

FOREIGN PATENT DOCUMENTS

| | | | |
|---|---|---|---|
| JP | 7-318150 | A | 12/1995 |
| JP | 2010-121912 | A | 6/2010 |
| JP | 2016-57038 | A | 4/2016 |

OTHER PUBLICATIONS

Extended European Search Report for European Application No. 21781714.7, dated Aug. 8, 2023.
International Preliminary Report on Patentability and English translation of the Written Opinion of the International Searching Authority for International Application No. PCT/JP2021/011091, dated Oct. 13, 2022.

* cited by examiner

FIG. 3

| ALL INDOOR UNITS | | OUTSIDE AIR PROCESSOR |
|---|---|---|
| (A) | OUTPUT RESTRICTION CONTROL (ALL INDOOR UNITS SHIFT TO SUPPRESSION CONTROL OR SUPPRESSION CONTROL AND STOP CONTROL) | SUPPRESSION CONTROL |
| (B) | STOP CONTROL | SUPPRESSION CONTROL |
| | | |
| (C) | (A)→ ANY OF INDOOR UNITS SHIFTS TO ORDINARY OPERATION CONTROL | ORDINARY OPERATION CONTROL |
| (D) | (B)→ ANY OF INDOOR UNITS SHIFTS TO ORDINARY OPERATION CONTROL | ORDINARY OPERATION CONTROL |

FIG. 5

| | ALL INDOOR UNITS | OUTSIDE AIR PROCESSOR |
|---|---|---|
| (E) | OUTPUT RESTRICTION CONTROL (ALL INDOOR UNITS SHIFT TO SUPPRESSION CONTROL OR SUPPRESSION CONTROL AND STOP CONTROL) | SUPPRESSION CONTROL |
| (F) | STOP CONTROL | STOP CONTROL |
| | | |
| (G) | (E)→ ANY OF INDOOR UNITS SHIFTS TO ORDINARY OPERATION CONTROL | ORDINARY OPERATION CONTROL |
| (H) | (F)→ ANY OF INDOOR UNITS SHIFTS TO ORDINARY OPERATION CONTROL | STOP CONTROL |

AIR CONDITIONING SYSTEM FOR SELECTIVELY SUPPRESSING INDOOR AND OUTDOOR UNIT OPERATION

CROSS REFERENCE TO RELATED APPLICATIONS

This application is a Continuation of PCT International Application No. PCT/JP2021/011091, filed on Mar. 18, 2021, which claims priority under 35 U.S.C. 119 (a) to Patent Application No. 2020-066857, filed in Japan on Apr. 2, 2020, all of which are hereby expressly incorporated by reference into the present application.

TECHNICAL FIELD

The present disclosure relates to an air conditioning system.

BACKGROUND ART

Patent Literature 1 discloses an air conditioning system including an air conditioner and an outside air processor. The air conditioner includes an outdoor unit and an indoor unit that are connected to each other with a refrigerant circuit. The indoor unit takes in air in a room, adjusts a temperature of the air, and blows out the air into the room. The outside air processor takes in air outside the room, adjusts a temperature and a humidity of the air, and blows out the air into the room.

CITATION LIST

Patent Literature

PATENT LITERATURE 1: Japanese Laid-Open Patent Publication No. 2010-121912

SUMMARY

An air conditioning system according to the present disclosure includes: an outdoor unit including a control device; an indoor unit communicably connected to the control device; and an outside air processor communicably connected to the control device.

In the air conditioning system, the indoor unit is capable of performing ordinary operation control to adjust a temperature of air in a room, the air being taken in the indoor unit, and supply the air into the room, and output restriction control under which an output is restricted as compared with an output under the ordinary operation control.

The outside air processor is capable of performing ordinary operation control to adjust at least one of a temperature and a humidity of air outside the room, the air being taken in the outside air processor, and supply the air into the room, and output restriction control under which an output is restricted as compared with an output under the ordinary operation control.

The control device causes the outside air processor to shift from the ordinary operation control to the output restriction control on condition that the indoor unit shifts from the ordinary operation control to the output restriction control.

BRIEF DESCRIPTION OF THE DRAWINGS

FIG. 3 is a table illustrating a correspondence relationship between output restriction control by an indoor unit and output restriction control by an outside air processor under association control.

FIG. 5 is a table illustrating a correspondence relationship between the output restriction control by the indoor unit and the output restriction control by the outside air processor under the association control according to a modification.

DETAILED DESCRIPTION

Configuration of Air Conditioning System

Figure 1:
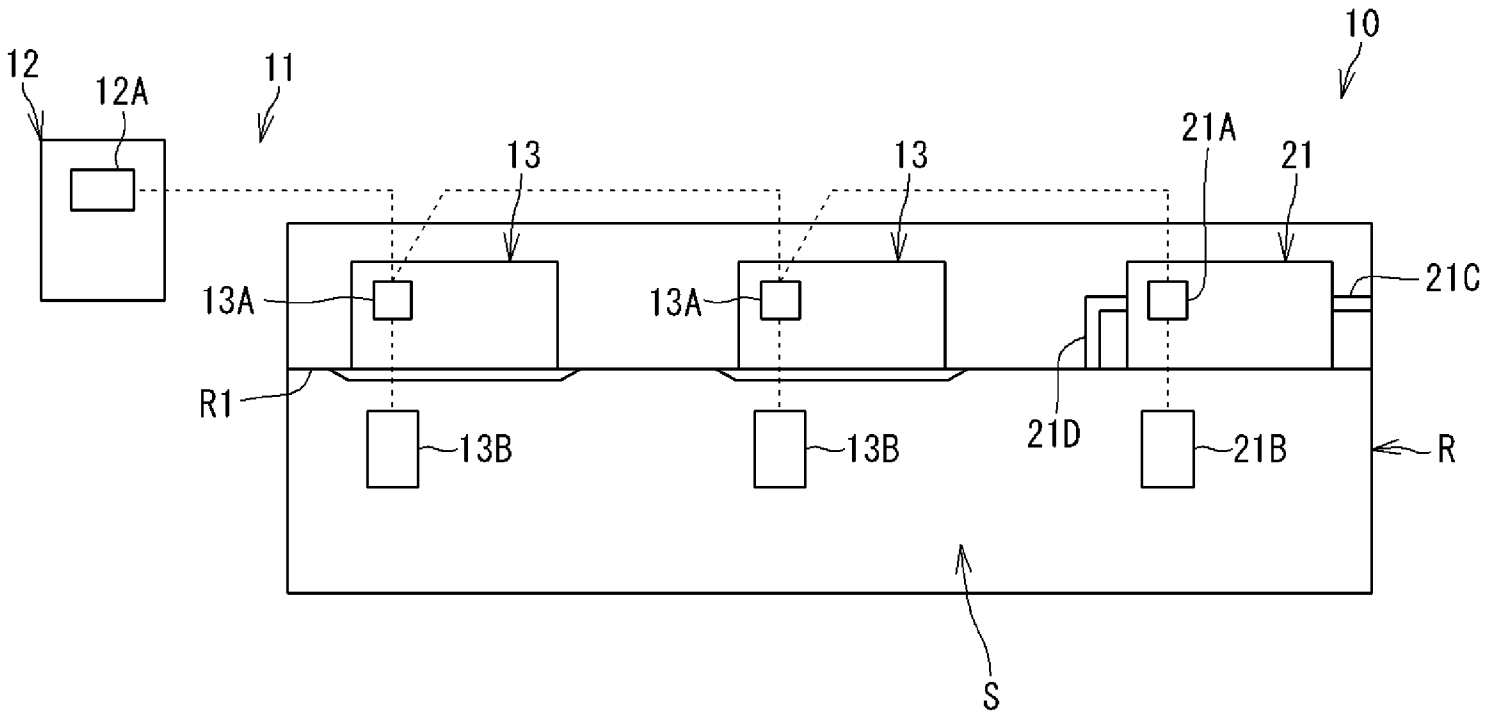
FIG. 1 is a diagram illustrating an exemplary configuration of an air conditioning system according to an embodiment of the present disclosure.

FIG. 1 is a diagram illustrating an exemplary configuration of an air conditioning system according to an embodiment of the present disclosure. The air conditioning system 10 adjusts a temperature and a humidity inside a room R (i.e., a target space S). The air conditioning system 10 includes an air conditioner 11 and an outside air processor 21. The air conditioner 11 includes an outdoor unit 12 installed outside the room R, and an indoor unit 13 installed inside the room R. In this embodiment, the indoor unit 13 is installed on a ceiling R1 or in an attic. The outside air processor 21 is installed in the attic of the room R. The outside air processor 21 is connected to the outside through a duct 21C and is connected to the target space S through a duct 21D.

The outdoor unit 12 includes a first control device 12A. The indoor unit 13 includes a second control device 13A. The second control device 13A of the indoor unit 13 is communicably connected to the first control device 12A of the outdoor unit 12, with a communication line. A remote controller 13B is connected to the second control device 13A of the indoor unit 13. The remote controller 13B allows a user to operate the air conditioner 11.

In this embodiment, the air conditioner 11 includes one outdoor unit 12 and a plurality of indoor units 13 each connected to the outdoor unit 12. Each of the second control devices 13A of the indoor units 13 is communicably connected to the first control device 12A of the outdoor unit 12. The first control device 12A of the outdoor unit 12 receives identification codes from the second control devices 13A of the respective indoor units 13, thereby distinguishing the indoor units 13 from one another. A plurality of remote controllers 13B may be provided for the respective indoor units 13 or a single remote controller 13B may be provided for the plurality of indoor units 13.

The outside air processor 21 includes a third control device 21A. The third control device 21A of the outside air processor 21 is communicably connected to the first control device 12A of the outdoor unit 12, with a communication line. A remote controller 21B is connected to the third control device 21A of the outside air processor 21. The remote controller 21B allows the user to operate the outside air processor 21. The first control device 12A of the outdoor unit 12 receives an identification code from the third control device 21A of the outside air processor 21, thereby distinguishing the outside air processor 21 from each indoor unit 13.

Each of the first, second, and third control devices 12A, 13A, and 21A is practicable using a computer including a processor, a memory, and the like. Each of the first, second, and third control devices 12A, 13A, and 21A exerts various functions in such a way that the processor executes a control program stored in the memory.

Figure 2:
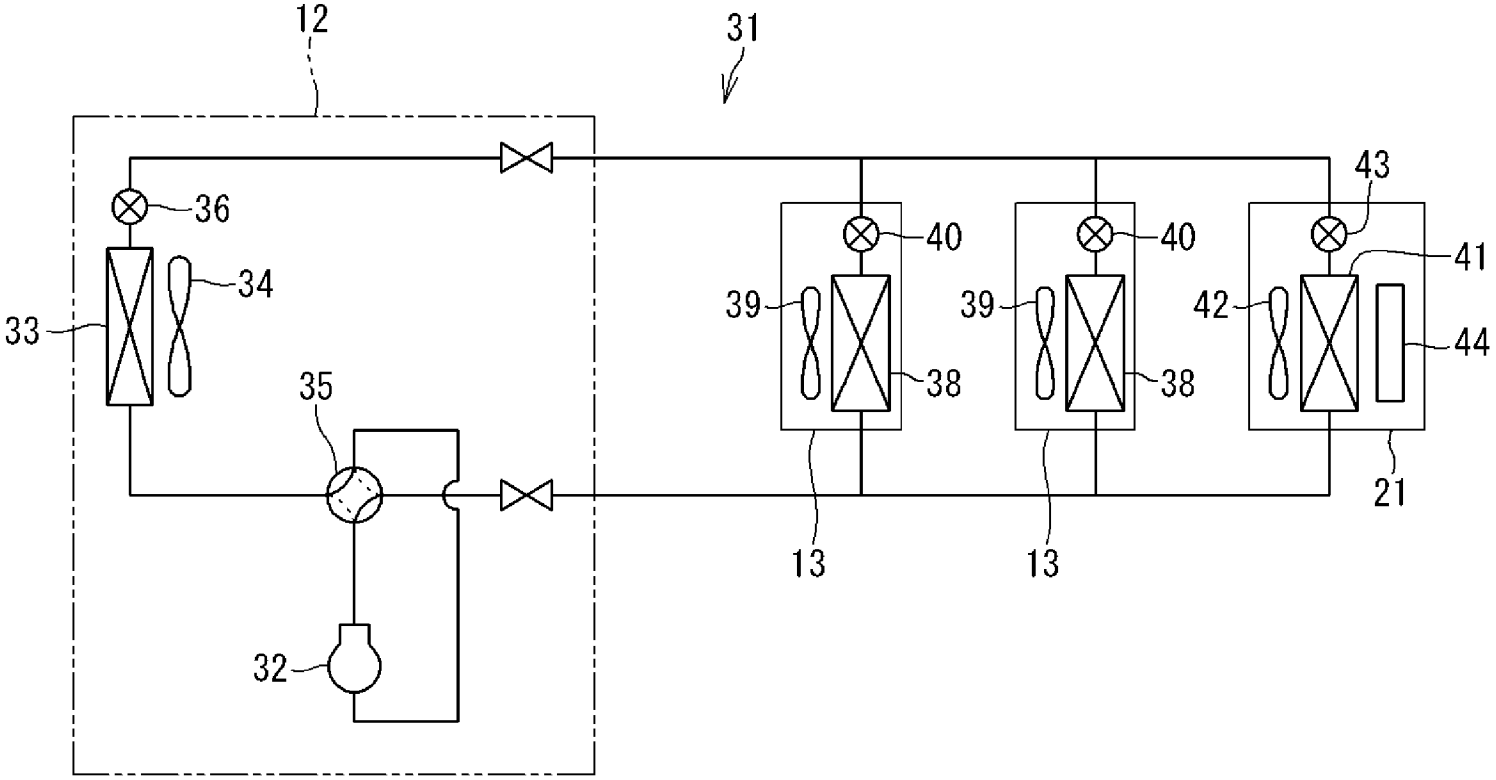
FIG. 2 is a diagram illustrating an exemplary refrigerant circuit in the air conditioning system.

FIG. 2 is a diagram illustrating an exemplary refrigerant circuit in the air conditioning system 10.

The outdoor unit 12, the indoor units 13, and the outside air processor 21 are connected to each other with a single-route refrigerant circuit 31. The outdoor unit 12 includes, for example, a compressor 32, an outdoor heat exchanger 33, a fan 34, a four-way switching valve 35, and an expansion mechanism 36. The compressor 32 causes a refrigerant to circulate through the refrigerant circuit. The outdoor heat exchanger 33 causes the refrigerant to exchange heat with air to increase or decrease a temperature of the air. The fan 34 generates a flow of air and provides the air to the outdoor heat exchanger 33. The four-way switching valve 35 switches between a way to cause the refrigerant discharged from the compressor 32 to flow toward the outdoor heat exchanger 33 and a way to cause the refrigerant to flow toward indoor heat exchangers 38 and 41 which will be described later. The expansion mechanism 36 includes, for example, an electric expansion valve and adjusts a flow rate of the refrigerant flowing through the outdoor heat exchanger 33. In the outdoor unit 12, the first control device 12A (see FIG. 1) controls operations of the compressor 32, fan 34, four-way switching valve 35, and expansion mechanism 36.

Each indoor unit 13 includes, for example, the indoor heat exchanger 38, a fan 39, and an expansion mechanism 40. The indoor heat exchanger 38 causes the refrigerant to exchange heat with air to increase or decrease a temperature of the air. The fan 39 generates a flow of air and provides the air to the indoor heat exchanger 38. The expansion mechanism 40 includes, for example, an electric expansion valve and adjusts a flow rate of the refrigerant flowing through the indoor heat exchanger 38. In the indoor unit 13, the second control device 13A (see FIG. 1) controls operations of the fan 39 and expansion mechanism 40.

The outside air processor 21 includes, for example, the indoor heat exchanger 41, a fan 42, an expansion mechanism 43, and a humidifier 44. The indoor heat exchanger 41 causes the refrigerant to exchange heat with air to increase or decrease a temperature of the air. The fan 42 generates a flow of air and provides the air to each of the indoor heat exchanger 41 and the humidifier 44. The expansion mechanism 43 includes, for example, an electric expansion valve and adjusts a flow rate of the refrigerant flowing through the indoor heat exchanger 41. The humidifier 44 includes, for example, an element capable of retaining moisture, and humidifies air that passes through the element. In the outside air processor 21, the third control device 21A controls operations of the fan 42 and expansion mechanism 43.

The outdoor unit 12, the indoor units 13, and the outside air processors 21 are each capable of performing a known vapor compression refrigeration cycle operation, thereby conditioning the air in the target space S. According to this refrigeration cycle operation, each indoor unit 13 performs air conditioning by taking in the air in the target space S, causing the indoor heat exchanger 38 to adjust the temperature of the air, and blowing out the air into the target space S. In this description, an output of each indoor unit 13 refers to a capability of the indoor unit 13 to increase or decrease the temperature of the air in the target space S.

The outside air processor 21 performs air conditioning by taking in outside air, adjusting a temperature and a humidity of the outside air, and blowing out the outside air into the target space S. In the outside air processor 21, specifically, the fan 42 takes in outside air, the indoor heat exchanger 41 adjusts a temperature of the outside air, and the humidifier 44 adjusts a humidity of the outside air. In this description, an output of the outside air processor 21 refers to a capability of the outside air processor 21 to increase or decrease the temperature and humidity of the air in the target space S. The outside air processor 21 may alternatively be configured to adjust one of a temperature and a humidity of the target space S.

In each indoor unit 13, the second control device 13A performs ordinary operation control and output restriction control under which the output is restricted as compared with the output under the ordinary operation control. The ordinary operation control is control to adjust an opening degree of the expansion mechanism 40 and a number of rotations of the fan 39, thereby adjusting the temperature of the target space S to a predetermined target temperature. The output restriction control includes suppression control to suppress the output and control to stop the operation (stop control). The suppression control may be, for example, control to close the expansion mechanism 40 while driving the fan 39, thereby stopping a flow of the refrigerant to the indoor heat exchanger 38. The stop control may be control to close the expansion mechanism 40 and stop the fan 39 when the user stops the operation with the remote controller 13B.

Also in the outside air processor 21, the third control device 21A performs ordinary operation control and output restriction control under which the output is restricted as compared with the output under the ordinary operation control. The ordinary operation control is control to adjust an opening degree of the expansion mechanism 43 and a number of rotations of the fan 42, thereby adjusting the temperature and humidity of the target space S to predetermined target values. The output restriction control includes suppression control to suppress the output and control to stop the operation (stop control). The suppression control may be, for example, control to close the expansion mechanism 43 while driving the fan 42, thereby stopping a flow of the refrigerant to the indoor heat exchanger 41. The stop control may be control to close the expansion mechanism 43 and stop the fan 42 when the user stops the operation with the remote controller 21B.

The first control device 12A of the outdoor unit 12 communicates with the second control device 13A of each indoor unit 13 and the third control device 21A of the outside air processor 21 to receive control states from the second control device 13A and third control device 21A. Therefore, the first control device 12A of the outdoor unit 12 is capable of recognizing a present state of each of the indoor unit 13 and the outside air processor 21 performing the ordinary operation control or the output restriction control.

According to this embodiment, the first control device 12A of the outdoor unit 12 performs "association control" to cause the outside air processor 21 to shift to the output restriction control in association with a shift of each indoor unit 13 to the output restriction control. Next, a specific description will be given of the "association control".

Association Control by First Control Device 12A of Outdoor Unit 12

FIG. 3 is a table illustrating a correspondence relationship between the output restriction control by each indoor unit 13 and the output restriction control by the outside air processor 21 under the association control. This table shows a correspondence between a state of each indoor unit 13 performing the output restriction control and a state of the outside air processor 21 performing the output restriction control, the outside air processor 21 being shifted to this state by the first control device 12A of the outdoor unit 12. The first control device 12A of the outdoor unit 12 performs control to cause the outside air processor 21 to shift to one of states (A) to (D) in FIG. 3.

In FIG. 3, the state (A) indicates that when all the indoor units 13 shift to the output restriction control and at least one of the indoor units 13 shifts to the suppression control, in other words, when all the indoor units 13 shift to the suppression control or when some of the indoor units 13 shift to the suppression control while some of the indoor units 13 shift to the stop control, the first control device 12A of the outdoor unit 12 performs control to cause the outside air processor 21 to shift to the suppression control.

In FIG. 3, the state (B) indicates that when all the indoor units 13 shift to the stop control, the first control device 12A of the outdoor unit 12 performs control to cause the outside air processor 21 to shift to the suppression control.

In FIG. 3, the state (C) indicates that when one of the indoor units 13 in the state (A) shifts to the ordinary operation control, the first control device 12A of the outdoor unit 12 performs control to cause the outside air processor 21 to shift from the suppression control to the ordinary operation control.

In FIG. 3, the state (D) indicates that when one of the indoor units 13 in the state (B) shifts to the ordinary operation control, the first control device 12A of the outdoor unit 12 performs control to cause the outside air processor 21 to shift from the suppression control to the ordinary operation control.

Next, a description will be given of a specific processing procedure in the first control device 12A under the association control.

Figure 4:
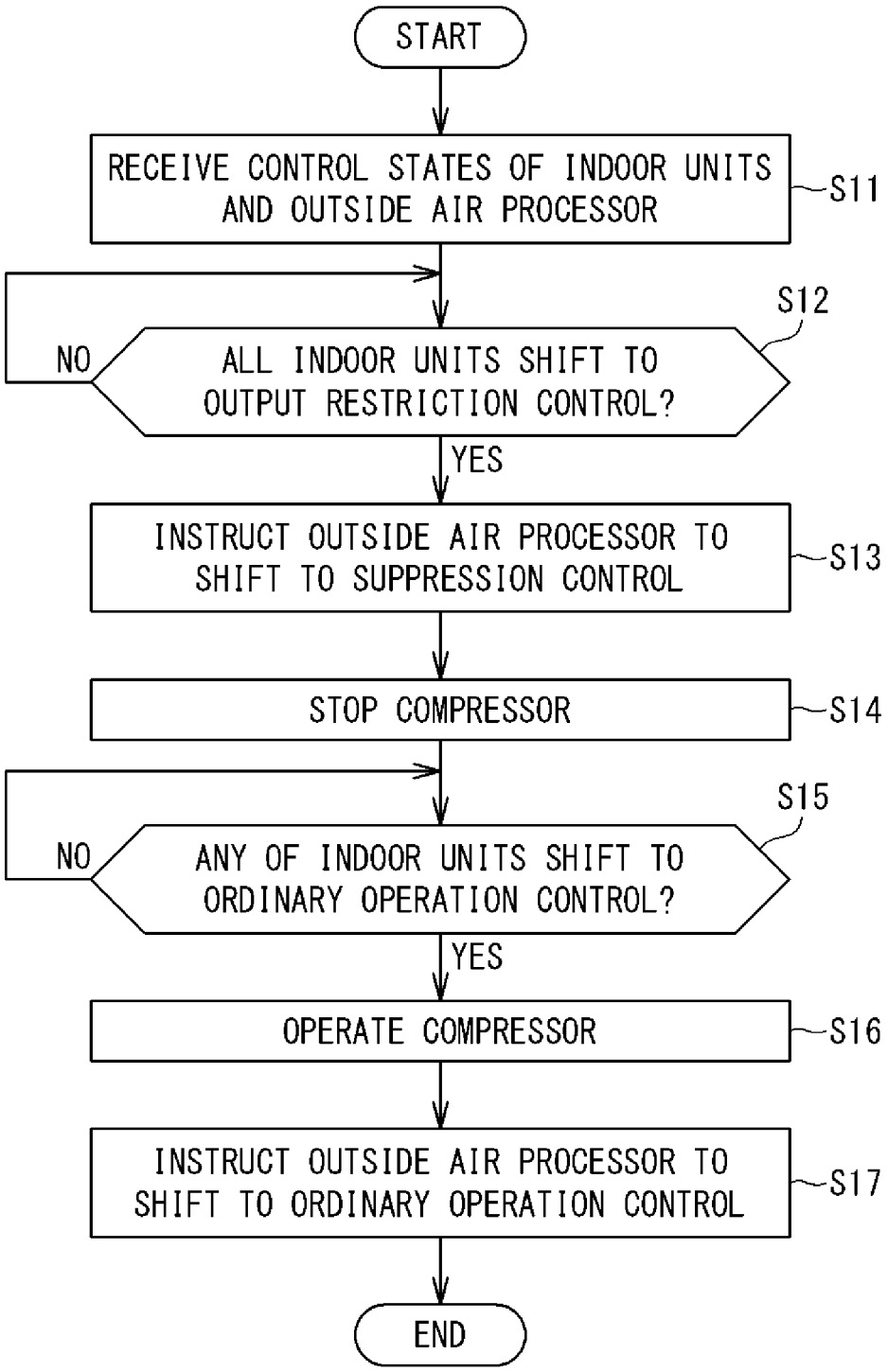
FIG. 4 is a flowchart illustrating an exemplary processing procedure in a first control device of an outdoor unit from a shift of the indoor unit to the output restriction control to a return to ordinary operation control.

FIG. 4 is a flowchart illustrating an exemplary processing procedure in the first control device 12A of the outdoor unit 12 from a shift of each indoor unit 13 to the output restriction control to a return to the ordinary operation control.

As illustrated in FIG. 4, in step S11, the first control device 12A of the outdoor unit 12 receives control states of the indoor units 13 from the second control devices 13A and receives a control state of the outside air processor 21 from the third control device 21A.

In step S12, the first control device 12A determines whether all the indoor units 13 shift to the output restriction control, in other words, whether all the indoor units 13 shift to the suppression control (the state (A) in FIG. 3) or the stop control (the state (B) in FIG. 3). When the first control device 12A makes a positive determination (YES) in step S12, then, in step S13, the first control device 12A transmits a signal instructing a shift to the suppression control to the third control device 21A of the outside air processor 21. The third control device 21A of the outside air processor 21 performs the suppression control, based on the instruction signal from the first control device 12A.

In step S14, next, the first control device 12A performs control to stop the compressor 32 of the outdoor unit 12. Since all the indoor units 13 shift to the suppression control or the stop control and the outside air processor 21 shifts to the suppression control before the processing proceeds to step S13, no problem occurs even when the compressor 32 is stopped. Stopping the compressor 32 enables a reduction in operating time and a reduction in power consumption. The shift of the outside air processor 21 to the suppression control may alternatively be achieved when the first control device 12A performs control to stop the compressor 32. For example, when the compressor 32 is stopped, the refrigerant does not flow into the indoor heat exchanger 41 of the outside air processor 21; therefore, the outside air processor 21 substantially shifts to the suppression control.

In step S15, when the first control device 12A of the outdoor unit 12 receives a signal indicating a shift to the ordinary operation control from the second control device 13A of any of the indoor units 13, then, in step S16, the first control device 12A of the outdoor unit 12 restarts the operation of the compressor 32. Next, in step S17, the first control device 12A transmits a signal instructing a shift to the ordinary operation control to the third control device 21A of the outside air processor 21. The third control device 21A of the outside air processor 21 performs the ordinary operation control, based on the instruction signal from the first control device 12A.

The first control device 12A of the outdoor unit 12 is thus capable of causing the outside air processor 21 to shift to the output restriction control in association with the output restriction control by the indoor units 13. This configuration thus eliminates continuation of an unnecessary operation of the outside air processor 21 while the indoor units 13 perform the suppression control or stop, and therefore enables a reduction in power consumption owing to the wasteful operation of the outside air processor 21.

Modifications

FIG. 5 is a table illustrating a correspondence relationship between the output restriction control by each indoor unit 13 and the output restriction control by the outside air processor 21 under the association control according to a modification. The first control device 12A of the outdoor unit 12 performs control to cause the outside air processor 21 to shift to one of states (E) to (H) in FIG. 5.

In FIG. 5, the state (E) indicates that when all the indoor units 13 shift to the output restriction control and at least one of the indoor units 13 shifts to the suppression control, in other words, when all the indoor units 13 shift to the suppression control or when some of the indoor units 13 shift to the suppression control while some of the indoor units 13 shift to the stop control, the first control device 12A of the outdoor unit 12 performs control to cause the outside air processor 21 to shift to the suppression control.

In FIG. 5, the state (F) indicates that when all the indoor units 13 shift to the stop control, the first control device 12A of the outdoor unit 12 performs control to cause the outside air processor 21 to shift to the stop control.

In FIG. 5, the state (G) indicates that when one of the indoor units 13 in the control state (E) shifts to the ordinary operation control, the first control device 12A of the outdoor unit 12 performs control to cause the outside air processor 21 to shift from the suppression control to the ordinary operation control.

In FIG. 5, the state (H) indicates that when one of the indoor units 13 in the control state (F) shifts to the ordinary operation control, the outdoor unit 12 is maintained in a stopped state.

Next, a description will be given of a specific processing procedure in the first control device 12A under the association control according to the modification.

Figure 6:
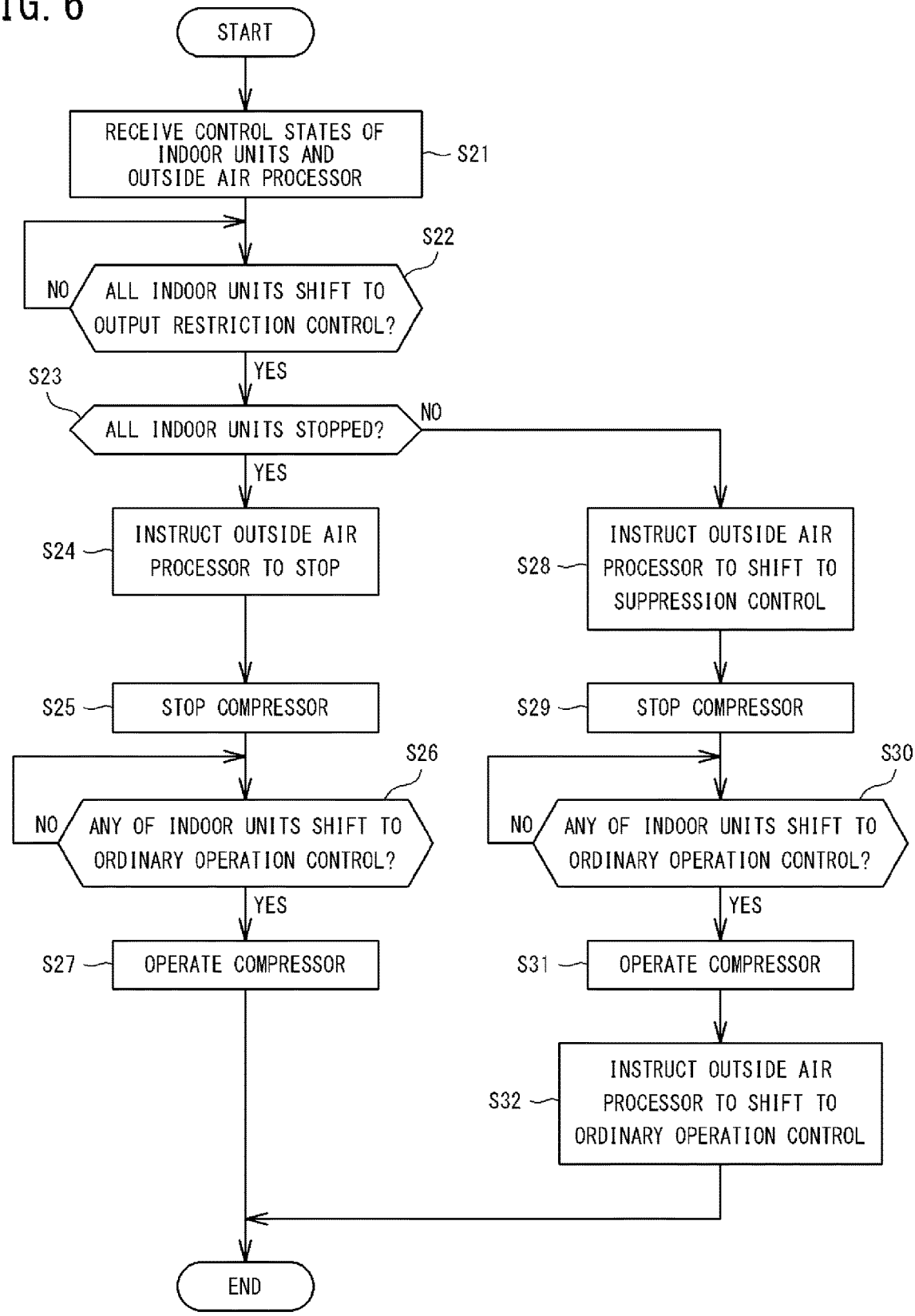
FIG. 6 is a flowchart illustrating an exemplary processing procedure in the first control device of the outdoor unit from a shift of the indoor unit to the output restriction control to a return to the ordinary operation control.

FIG. 6 is a flowchart illustrating an exemplary processing procedure in the first control device 12A of the outdoor unit 12 from a shift of each indoor unit 13 to the output restriction control to a return to the ordinary operation control.

As illustrated in FIG. 6, in step S21, the first control device 12A of the outdoor unit 12 receives control states of the indoor units 13 from the second control devices 13A and receives a control state of the outside air processor 21 from the third control device 21A.

In step S22, the first control device 12A determines whether all the indoor units 13 shift to the output restriction control. When the first control device 12A makes a positive determination (YES) in step S22, then, in step S23, the first control device 12A determines whether all the indoor units 13 shift to the stop control. A positive determination (YES) in step S23 made by the first control device 12A indicates that all the indoor units 13 shift to the stop control (the state (F) in FIG. 5). A negative determination (NO) made by the first control device 12A indicates that all the indoor units 13 shift to the output restriction control and at least one of the indoor units 13 shifts to the suppression control (the state (E) in FIG. 5).

When the first control device 12A of the outdoor unit 12 makes the positive determination (YES) in step S23, then, in step S24, the first control device 12A of the outdoor unit 12 transmits a signal instructing a shift to the stop control to the third control device 21A of the outside air processor 21. The third control device 21A of the outside air processor 21 performs the stop control, based on the instruction signal from the first control device 12A.

In step S25, the first control device 12A of the outdoor unit 12 performs control to stop the compressor 32 of the outdoor unit 12. Since all the indoor units 13 and the outside air processor 21 shift to the stop control before the processing proceeds to step S25, no problem occurs even when the compressor 32 is stopped. This configuration thus reduces an operating time of the compressor 32, leading to a reduction in power consumption.

In step S26, when the first control device 12A of the outdoor unit 12 receives a signal indicating a shift to the ordinary operation control from the second control device 13A of any of the indoor units 13, then, in step S27, the first control device 12A of the outdoor unit 12 restarts the operation of the compressor 32. This configuration thus enables the ordinary operation control by any of the indoor units 13. Thereafter, the first control device 12A maintains the outside air processor 21 in the stopped state without transmitting a signal instructing a shift to the ordinary operation control to the third control device 21A of the outside air processor 21.

On the other hand, when the first control device 12A of the outdoor unit 12 makes the negative determination (NO) in step S23, then, in step S28, the first control device 12A of the outdoor unit 12 transmits a signal instructing a shift to the suppression control to the third control device 21A of the outside air processor 21. The third control device 21A of the outside air processor 21 performs the suppression control, based on the instruction signal from the first control device 12A.

In step S29, next, the first control device 12A performs control to stop the compressor 32 of the outdoor unit 12. Since all the indoor units 13 shift to the suppression control or the stop control and the outside air processor 21 shifts to the suppression control before the processing proceeds to step S29, no problem occurs even when the compressor 32 is stopped. This configuration thus reduces an operating time of the compressor 32, leading to a reduction in power consumption. The shift of the outside air processor 21 to the suppression control may alternatively be achieved when the first control device 12A performs control to stop the compressor 32.

In step S30, when the first control device 12A of the outdoor unit 12 receives a signal indicating a shift to the ordinary operation control from the second control device 13A of any of the indoor units 13, then, in step S31, the first control device 12A of the outdoor unit 12 restarts the operation of the compressor 32. This configuration thus enables the ordinary operation control by any of the indoor units 13. Next, in step S32, the first control device 12A transmits a signal instructing a shift to the ordinary operation control to the third control device 21A of the outside air processor 21. The third control device 21A of the outside air processor 21 performs the ordinary operation control, based on the instruction signal from the first control device 12A.

Also in the foregoing modification, the first control device 12A of the outdoor unit 12 is thus capable of causing the outside air processor 21 to shift to the output restriction control in association with the output restriction control by the indoor units 13. This configuration thus eliminates continuation of an unnecessary operation of the outside air processor 21 while the indoor units 13 perform the suppression control or stop, and therefore enables a reduction in power consumption owing to the wasteful operation of the outside air processor 21.

Other Embodiments

The first control device 12A of the outdoor unit 12 may receive selection of one of the way of the association control illustrated in FIGS. 3 and 4 and the way of the association control illustrated in FIGS. 5 and 6 and perform the association control in the selected way. In this case, for example, a control board on which the computer of the first control device 12A is mounted is provided with a selector, such as a DIP switch, for selecting the way of the association control. In installing the air conditioner 11 and the outside air processor 21, the way of the association control can be selected through settings by a service engineer.

In the foregoing embodiment, the air conditioning system 10 includes the plurality of indoor units 13. The air conditioning system 10 may alternatively include one indoor unit 13. In the foregoing embodiment, the air conditioning system 10 includes one outside air processor 21. The air conditioning system 10 may alternatively include a plurality of outside air processors 21. In the foregoing embodiment, the air conditioning system 10 includes one outdoor unit 12. The air conditioning system 10 may alternatively include a plurality of outdoor units 12. In this case, the association control can be performed by the first control device 12A of one outdoor unit (master) 12 of the plurality of outdoor units 12.

The suppression control by each of the indoor units 13 and the suppression control by the outside air processor 21 described in the foregoing embodiment may alternatively be control to make the number of rotations of each of the fans 39 and 42 equal to that under the ordinary operation control and make the opening degree of each of the expansion mechanisms 40 and 43 smaller than that under the ordinary operation control. The suppression control may be control to decrease the number of rotations of each of the fans 39 and 42 so as to be smaller than that under the ordinary operation control, in order to achieve power saving by a reduction in amount of heat to be exchanged by each of the indoor heat exchangers 38 and 41. In this case, the compressor 32 is not necessarily stopped in step S14 of FIG. 4 and in step S29 of FIG. 6.

Action and Effects of Embodiment

The outside air processor is typically installed in, for example, an attic which is an inconspicuous place, and is connected to a blow-out port formed in, for example, a ceiling, through a duct. Therefore, some users do not know the presence of the outside air processor and therefore stop only the operation of the air conditioning apparatus while keeping the outside air processor operating even after the use of the room, which may result in wasteful power consumption. Therefore, an object of the present disclosure is to reduce power consumption by an operation of an outside air processor.

(1) According to the foregoing embodiment, an air conditioning system 10 includes an outdoor unit 12 including a first control device 12A, an indoor unit 13 communicably connected to the first control device 12A, and an outside air processor 21 communicably connected to the first control device 12A. The indoor unit 13 is capable of performing ordinary operation control to adjust a temperature of air in a room, the air being taken in the indoor unit 13, and supply the air into the room, and output restriction control under which an output is restricted as compared with an output under the ordinary operation control. The outside air processor 21 is capable of performing ordinary operation control to adjust at least one of a temperature and a humidity of air outside the room, the air being taken in the outside air processor 21, and supply the air into the room, and output restriction control under which an output is restricted as compared with an output under the ordinary operation control. The first control device 12A causes the outside air processor 21 to shift from the ordinary operation control to the output restriction control on condition that the indoor unit 13 shifts from the ordinary operation control to the output restriction control. The air conditioning system 10 is therefore capable of restricting the output of the outside air processor 21 in association with the restriction to the output of the indoor unit 13 occurring, for example, in a case where the indoor unit 13 shifts to suppression control since a temperature of a target space S reaches a predetermined target temperature or in a case where the operation of the indoor unit 13 stops. The air conditioning system 10 is thus capable of reducing power consumption owing to the operation of the outside air processor 21.

The air conditioning system 10 according to the foregoing embodiment does not include a known centralized controller for collectively controlling the outdoor unit 12, the indoor unit 13, and the outside air processor 21. However, the first control device 12A of the outdoor unit 12 is capable of recognizing the control state of the indoor unit 13 and the control state of the outside air processor 21. In addition, the first control device 12A instructs the outside air processor 21 to shift to the output restriction control or the ordinary operation control. The air conditioning system 10 is thus capable of achieving association control on the indoor unit 13 and the outside air processor 21. Therefore, even the relatively small-scale air conditioning system 10 including no centralized controller is capable of collectively controlling a plurality of the indoor units 13 and the outside air processor 21.

(2) According to the foregoing embodiment, the air conditioning system 10 includes the plurality of indoor units 13, and the first control device 12A causes the outside air processor 21 to shift to the output restriction control on condition that all the indoor units 13 shift to the output restriction control. In the case where the air conditioning system 10 includes the plurality of indoor units 13, the air conditioning system 10 is capable of suppressing the output of the outside air processor 21 in association with the shift of all the indoor units 13 to the output restriction control.

(3) According to the foregoing embodiment, the output restriction control by each of the indoor units 13 and the output restriction control by the outside air processor 21 each include stop control to stop the output. In the example illustrated in FIGS. 5 and 6, the first control device 12A causes the outside air processor 21 to shift to the stop control on condition that all the indoor units 13 shift to the stop control. The user who uses the room R is less likely to notice the presence of the outside air processor 21 installed in the attic and therefore sometimes stops only the indoor units 13 and forgets to stop the outside air processor 21 even after the use of the room R. Even in this case, the air conditioning system 10 according to the foregoing embodiment is capable of automatically stopping the outside air processor 21 in association with the stop of the indoor units 13, and is therefore capable of reducing wasteful power consumption.

(4) According to the foregoing embodiment, the output restriction control by each of the indoor units 13 includes stop control to stop the output, and the output restriction control by the outside air processor 21 includes suppression control to suppress the output. In the example illustrated in FIGS. 3 and 4, the first control device 12A causes the outside air processor 21 to shift to the suppression control on condition that all the indoor units 13 shift to the stop control. The air conditioning system 10 is therefore capable of suppressing the output of the outside air processor 21 in association with the suppression of outputs of all the indoor units 13 under the stop control.

(5) According to the foregoing embodiment, the output restriction control by each of the indoor units 13 includes stop control to stop the output and suppression control to suppress the output, and the output restriction control by the outside air processor 21 includes suppression control to suppress the output. According to the foregoing embodiment, the first control device 12A causes the outside air processor 21 to shift to the suppression control on condition that all the indoor units 13 shift to the output restriction control and at least one of the indoor units 13 shifts to the suppression control. The air conditioning system 10 is therefore capable of suppressing the output of the outside air processor 21 in association with the suppression of outputs of all the indoor units 13 under the suppression control or the stop control.

(6) According to the foregoing embodiment, in the example illustrated in FIGS. 5 and 6, the outside air processor 21 is maintained at the stop control on condition that the outside air processor 21 shifts to the stop control in association with a shift of all the indoor units 13 to the stop control, and then at least one of the indoor units 13 shifts to the ordinary operation control. Therefore, even when any of the indoor units 13 shifts from the stop control to the ordinary operation control, the air conditioning system 10 is capable of suppressing an unnecessary operation of the outside air processor 21, by maintaining the outside air processor 21 at the stop control regardless of the shift.

(7) According to the foregoing embodiment, in the example illustrated in FIGS. 3 and 4, the first control device 12A causes the outside air processor 21 to shift to the ordinary operation control on condition that the outside air processor 21 shifts to the suppression control in association with a shift of all the indoor units 13 to the stop control, and then any of the indoor units 13 shifts to the ordinary operation control. The air conditioning system 10 is therefore capable of causing the outside air processor 21 to shift to the ordinary operation control in association with the shift of any of the indoor units 13 to the ordinary operation control, without a user's operation.

(8) According to the foregoing embodiment, the first control device 12A causes the outside air processor 21 to shift to the ordinary operation control on condition that the outside air processor 21 shifts to the suppression control in association with a shift of all the indoor units 13 to the suppression control or a shift of all the indoor units 13 to the stop control and the suppression control, and then any of the indoor units 13 shifts to the ordinary operation control. The air conditioning system 10 is therefore capable of causing the outside air processor 21 to shift to the ordinary operation control in association with the shift of any of the indoor units 13 to the ordinary operation control, without a user's operation.

(9) According to the foregoing embodiment, the outdoor unit 12 includes a compressor 32, and the outdoor unit 12, the indoor units 13, and the outside air processor 21 are connected to each other with a refrigerant circuit 31 through which a refrigerant circulates by the compressor 32. The suppression control by the outside air processor 21 involves a stop of the compressor 32. The air conditioning system 10 is therefore capable of causing the outside air processor 21 to perform the suppression control, by stopping the compressor 32 of the outdoor unit 12.

While various embodiments have been described herein above, it is to be appreciated that various changes in form and detail may be made without departing from the spirit and scope presently or hereafter claimed.

REFERENCE SIGNS LIST

10 air conditioning system
12 outdoor unit
12A first control device
13 indoor unit
21 outside air processor
31 refrigerant circuit
32 compressor

The invention claimed is:

1. An air conditioning system comprising:
an outdoor unit including a control device;
an indoor unit communicably connected to the control device; and
an outside air processor communicably connected to the control device,
wherein
the indoor unit is capable of performing
ordinary operation control to adjust a temperature of air in a room, the air being taken in the indoor unit, and supply the air into the room, and
output restriction control under which an output is restricted as compared with an output under the ordinary operation control,
the outside air processor is capable of performing
ordinary operation control to adjust at least one of a temperature and a humidity of air outside the room, the air being taken in the outside air processor, and supply the air into the room, and
output restriction control under which an output is restricted as compared with an output under the ordinary operation control,
the control device causes the outside air processor to shift from the ordinary operation control to the output restriction control on condition that the indoor unit shifts from the ordinary operation control to the output restriction control,
the air conditioning unit further including a plurality of the indoor units,
the control device causes the outside air processor to shift to the output restriction control on condition that all the indoor units shift to the output restriction control,
the output restriction control by each of the indoor units and the output restriction control by the outside air processor each include stop control to stop the output, and
the control device causes the outside air shift the stop control on condition that all the indoor units shift to the stop control.

2. The air conditioning system according to claim 1, wherein
the output restriction control by each of the indoor units includes stop control to stop the output,
the output restriction control by the outside air processor includes suppression control to suppress the output, and
the control device causes the outside air processor to shift to the suppression control on condition that all the indoor units shift to the stop control.

3. The air conditioning system according to claim 1, wherein
the outside air processor is maintained at the stop control on condition that the outside air processor shifts to the stop control in association with a shift of all the indoor units to the stop control, and then at least one of the indoor units shifts to the ordinary operation control.

4. The air conditioning system according to claim 2, wherein
the outdoor unit includes a compressor,
the outdoor unit, the indoor units, and the outside air processor are connected to each other with a refrigerant circuit through which a refrigerant circulates by the compressor, and
the suppression control by the outside air processor involves a stop of the compressor.

5. The air conditioning system according to claim 1, wherein
the output restriction control by each of the indoor units includes stop control to stop the output and suppression control to suppress the output,
the output restriction control by the outside air processor includes suppression control to suppress the output, and
the control device causes the outside air processor to shift to the suppression control on condition that all the indoor units shift to the output restriction control and at least one of the indoor units shifts to the suppression control.

6. The air conditioning system according to claim 2, wherein
the output restriction control by each of the indoor units includes stop control to stop the output and suppression control to suppress the output,
the output restriction control by the outside air processor includes suppression control to suppress the output, and
the control device causes the outside air processor to shift to the suppression control on condition that all the indoor units shift to the output restriction control and at least one of the indoor units shifts to the suppression control.

7. An air conditioning system comprising:

an outdoor unit including a control device;

an indoor unit communicably connected to the control device; and an outside air processor communicably connected to the control device, wherein the indoor unit is capable of performing ordinary operation control to adjust a temperature of air in a room, the air being taken in the indoor unit, and supply the air into the room, and output restriction control under which an output is restricted as compared with an output under the ordinary operation control, the outside air process capable of performing ordinary operation control to adjust at least one of a temperature and a humidity of air outside the room, the air being taken in the outside air processor, and supply the air into the room, and output restriction control under which an output is restricted as compared with an output under the ordinary operation control, the control device causes the outside air processor to shift from the ordinary operation control to the output restriction control on condition that the indoor unit shifts from the ordinary operation control to the output restriction control, the air conditioning system further includes a plurality of the indoor units, the control device causes the outside air processor to shift to the output restriction control on condition that all the indoor units shift to the output restriction control, the output restriction control by each of the indoor units includes stop control to stop the output and suppression control to suppress the output, the output restriction control by the outside air processor includes suppression control to suppress the output, and the control device causes the outside air processor to shift to the suppression control on condition that all the indoor units shift to the output restriction control and at least one of the indoor units shifts to the suppression control.

8. The air conditioning system according to claim 7, wherein the control device causes the outside air processor to shift to the ordinary operation control on condition that the outside air processor shifts to the suppression control in association with a shift of all the indoor units to the output restriction control, and then any of the indoor units shifts to the ordinary operation control.

9. The air conditioning system according to claim 5, wherein the outdoor unit includes a compressor, the outdoor unit, the indoor units, and the outside air processor are connected to each other with a refrigerant circuit through which a refrigerant circulates by the compressor, and the suppression control by the outside air processor involves a stop of the compressor.

10. The air conditioning system according to claim 8, wherein the outdoor unit includes a compressor, the outdoor unit, the indoor units, and the outside air processor are connected to each other with a refrigerant circuit through which a refrigerant circulates by the compressor, and the suppression control by the outside air processor involves a stop of the compressor.

11. An air conditioning system comprising:

an outdoor unit including a control device;

an indoor unit communicably connected to the control device; and an outside, air processor communicably connected to the control device, wherein the indoor unit is capable of performing ordinary operation control to adjust a temperature of air in a room, the air being taken in the indoor unit, and supply the air into the room, and output restriction control under which an output is restricted as compared with an output under the ordinary operation control, the outside air processor is capable of performing ordinary operation control to adjust at least one of a temperature and a humidity of air outside the room, the air being taken in the outside air processor, and supply the air into the room, and output restriction control under which an output is restricted as compared with an output under the ordinary operation control, the control device causes the outside air processor to shift from the ordinary operation control to the output restriction control on condition that the indoor unit shifts from the ordinary operation control to the output restriction control, the air conditioning system further includes a plurality of the indoor units, the control device causes the outside air processor to shift to the output restriction control on condition that all the indoor units shift to the output restriction control, the output restriction control by the outside air processor includes suppression control to suppress the output, the control device causes the outside air processor to shift to the suppression control on condition that all the indoor units shift to the stop control, and the control device causes the outside air processor to shift to the ordinary operation control on condition that the outside air processor shifts to the suppression control in association with a shift of all the indoor units to the stop control, and then any of the indoor units shifts to the ordinary operation control.

12. The air conditioning system according to claim 11, wherein the outdoor unit includes a compressor, the outdoor unit, the indoor units, and the outside air processor are connected to each other with a refrigerant circuit through which a refrigerant circulates by the compressor, and the suppression control by the outside air processor involves a stop of the compressor.

* * * * *